United States Patent [19]

Leigh et al.

[11] Patent Number: 4,965,100

[45] Date of Patent: Oct. 23, 1990

[54] CONDITIONING OF FABRICS

[75] Inventors: Arthur G. Leigh, Heswall; Douglas Wraige, Upton by Chester, both of England

[73] Assignee: Unilever Patent Holdings B.V., Rotterdam, Netherlands

[21] Appl. No.: 409,702

[22] Filed: Sep. 20, 1989

[30] Foreign Application Priority Data

Sep. 30, 1988 [GB] United Kingdom ..... 8823007

[51] Int. Cl.[5] ..... B05D 3/12

[52] U.S. Cl. ..... 427/242; 252/8.8; 428/305.5; 428/306.6; 428/308.4; 428/320.2

[58] Field of Search ..... 252/8.8; 427/242; 428/305.5, 306.6, 308.4, 320.2

[56] References Cited

U.S. PATENT DOCUMENTS

| | | | |
|---|---|---|---|
| 3,634,947 | 1/1972 | Furgal | 34/60 |
| 3,936,538 | 2/1976 | Marshall et al. | 427/242 |
| 4,070,520 | 1/1978 | Volz et al. | 428/160 |
| 4,105,813 | 8/1978 | Mizuno | 428/76 |
| 4,129,694 | 12/1978 | Cogliano et al. | 521/107 |
| 4,177,151 | 12/1979 | Siu et al. | 252/8.6 |
| 4,209,549 | 6/1980 | Murphy et al. | 427/11 |
| 4,297,406 | 10/1981 | Metcalfe et al. | 428/215 |
| 4,389,448 | 6/1983 | Green | 428/195 |

FOREIGN PATENT DOCUMENTS

| | | |
|---|---|---|
| 973663 | 9/1975 | Canada . |
| 1005204 | 2/1977 | Canada . |
| 1126454 | 6/1982 | Canada . |
| 0033134 | 8/1981 | European Pat. Off. . |
| 0068830 | 1/1983 | European Pat. Off. . |
| 1399728 | 7/1975 | United Kingdom . |
| 1482782 | 8/1977 | United Kingdom . |
| 1532950 | 11/1978 | United Kingdom . |
| 2066309 | 7/1981 | United Kingdom . |
| 2070657 | 9/1981 | United Kingdom . |

*Primary Examiner*—William J. Van Balen

*Attorney, Agent, or Firm*—Cushman, Darby & Cushman

[57] ABSTRACT

An article suitable for conditioning fabrics in a tumble dryer, comprising a combination of a substrate and a fabric-conditioning composition, the substrate comprising a porous material having a void volume of more than 90% and a cell count of more than 250 cells per cm, the fabric-conditioning composition comprising a fabric-softening material. The claimed article can spontaneously and consistently be adhered to the tumble dryer wall for one or more drying cycles. The moment at which the substrate no longer adheres to the tumble dryer wall coincides with the moment whereupon the amount of conditioning material which is released per drying cycle is insufficient to effect a satisfactory conditioning benefit.

8 Claims, No Drawings

CONDITIONING OF FABRICS

The present invention relates to an article suitable for conditioning of fabrics. In particular, the present invention relates to a combination of a substrate and a fabric-conditioning composition which can advantageously be used for providing conditioning benefits to fabrics which are treated in a tumble dryer.

In the treatment of fabrics in a tumble dryer it is known in the art to add one or more conditioning agents. For instance, for imparting a softening benefit to fabrics, it is known from CA No. 1 005 204 to commingle fabrics in a tumble dryer with a flexible substrate carrying a normally solid fabric-conditioning agent. In commingling fabrics with impregnated substrates, however, there is a risk that the conditioner may not be evenly distributed. Furthermore, the commingling of the fabrics with impregnated substrates requires the separation of the substrate from the fabrics after completion of the tumble dryer treatment. Especially in using flexible substrates, this separation is often time-consuming in that the substrates cannot readily be located.

For overcoming the above-mentioned problems it has been suggested, for instance in GB No. 2 066 309 and U.S. Pat. No. 3,634,947, to use conditioner-dispensing articles, comprising means for attachment of the substrate to the tumble dryer wall. The proposed articles are, however, of complex nature, which renders them difficult and costly to produce. Other proposals, such as for instance disclosed in GB No. 1 399 728, involve the use of separate means for attaching the conditioning article to the tumble dryer wall.

It is an object of the present invention to provide an article suitable for conditioning fabrics, which article can spontaneously and consistently be adhered to the tumble dryer wall without the need for the abovementioned complex attachment systems.

It is another object of the present invention to provide an article which can possibly be used during more than one cycle of the tumble dryer and still provide satisfactory conditioning benefits. Furthermore, it is an object of the present invention to provide an article which, after being used, provides a visual indication of the moment of functional exhaustion of the article.

Other possible benefits of an article according to the present invention are increased physical stability, reduced dripping, prolonged release of the conditioning agent, and higher possible weight ratios of substrate to conditioning agent.

According to the present invention, an article for conditioning fabrics comprises a combination of a substrate and a fabric-conditioning composition, the substrate comprising a porous material having a void volume of more than 90% and a cell count of more than 250 cells per cm, the fabric-conditioning composition comprising a fabric-softening material.

The use of porous foams as tumble dryer substrates has already been proposed, for instance in U.S. Pat. No. 4,389,448 and CA No. 973 663. The polyurethane or polystyrene foams as disclosed in these publications have a considerably lower cell count than substrates of the present invention. Although not yet fully understood, it is believed that, contrary to the teaching of these documents, a high cell count is an essential element of the present invention. Lower cell counts are believed to result in reduced absorption capacity, increased dripping, decreased physical stability and less satisfactory release of the conditioning agent. Furthermore, a lower cell count will generally not result in spontaneous and continuous adherence of the substrate to the tumble dryer, which is an important benefit of the articles according to the present invention.

The use of conventional woven or non-woven substrates impregnated with fabric-softening agents in a tumble dryer is also known in the art. These substrates may comprise micropores. For providing adequate strength to the substrates, it is, however, required that the total amount of free volume in these substrates is not too high. Conventional woven or non-woven substrates generally have free volumes far less than 90%. This low free volume renders them less suitable for combining them with considerable amounts of conditioning material without resulting in less satisfactory appearance of the product. This limitation to low add-on ratios renders them less suitable for repeated use. Furthermore, this limitation makes it generally impossible for the impregnated substrate to be consistently adhered to the tumble dryer wall for longer periods.

Surprisingly, it has been found that the combined features of a high free volume and a high cell count renders a substrate particularly useful for combination with a conditioning agent, and its subsequent use during the treatment of fabrics in a tumble dryer.

Therefore, the present invention relates to an article for conditioning fabrics comprising a combination of a substrate and a fabric-conditioning composition, the substrate comprising a porous material having a void volume of more than 90% and a cell count of more than 250 cells per cm, the fabric-conditioning composition comprising a fabric-softening material.

The substrate used in an article according to the invention can be in any shape and size which allows its use in a tumble dryer, such as for instance blocks, bars and coarse particulate materials. Especially useful is a substrate in the form of a sheet, preferably a flexible sheet. The single face surface area of such a sheet is preferably from 1–1000 $cm^2$, more preferably from 50–500 $cm^2$, most preferably between 100 and 250 $cm^2$. The thickness of such a sheet is preferably from 0.1 to 10 mm, more preferably between 0.5 and 5 mm, most preferably between 0.5 and 3 mm The substrate material can be any porous material having the required void volume and cell count. Particularly useful are porous polymeric substrate materials as described in EP No. 68 830, which is included here by reference. Especially useful are substrate materials having more than 95% void volume and a cell count of more than 350 per cm.

The conditioning agent to be combined with the substrate can be any material capable of providing conditioning benefits to fabrics in the tumble dryer stage. Preferably, fabric conditioner materials used in an article according to the present invention comprise more than 10% of softening material, more preferably more than 20% of softening material. Preferably, the conditioning agent comprises a cationic softening material, which may be selected from cationic, nonionic, amphoteric or anionic fabric softening materials. Such a cationic fabric softener is preferably a water-insoluble cationic fabric softener material. Suitable amphoteric fabric conditioning material for use in a composition according to the invention are fabric substantive amphotheric materials forming a particulate dispersion at a concentration of less than 1 g/l at at least one temperature between 0° and 100° C. Preferably at at least one temperature between 10° and 90 ° C., more preferred between 20° and 80° C. For the purpose of this invention a fabric substantive amphoteric material is preferably an amphoteric or zwitterionic tertiary or quaternary ammonium compound having either one single long hydrocarbyl side chain or two long hydrocarbyl chains. From these compounds the use of amphoteric or zwitterionic ammonium compounds having two long hydrocarbyl chains is particularly preferred for many reasons including costs, ease of processing and better stability and performance. Suitable amphoteric materials are for example disclosed in EP 89200545.5.

In this specification the expression hydrocarbyl chain refers to linear or branched alkyl or alkenyl chains optionally substituted or interrupted by functional groups such as —OH,—O—,—CONH—,—COO—,etc.

Preferably the amphoteric fabric substantive materials are water insoluble and have a solubility in water at pH 2.5° at 20° C. of less than 10 g/l. The HLB of the amphoteric fabric substantive material is preferably less than 10.0.

Suitable cationic fabric softener materials for use in a composition according to the present invention are cationic materials which are water-insoluble in that the material has a solubility in water at pH 2.5 and 20° C. of less than 10 g/l. Highly preferred materials are cationic quaternary ammonium salts having two C12–24 hydrocarbyl chains. Well-known species of substantially water-insoluble quaternary ammonium compounds have the formula

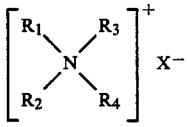

wherein $R_1$ and $R_2$ represent hydrocarbyl groups from about 12 to about 24 carbon atoms; $R_3$ and $R_4$ represent hydrocarbyl groups containing from 1 to about 4 carbon atoms; and X is an anion, preferably selected from halide, methyl sulfate and ethyl sulfate radicals.

Representative examples of these quaternary softeners include ditallow dimethyl ammonium chloride; ditallow dimethyl ammonium methyl sulfate; dihexadecyl dimethyl ammonium chloride; di(hydrogenated tallow) dimethyl ammonium methyl sulfate; dihexadecyl diethyl ammonium chloride; di(coconut) dimethyl ammonium chloride. Ditallow dimethyl ammonium chloride, di(hydrogenated tallow) dimethyl ammonium chloride, di(coconut) dimethyl ammonium chloride and di(coconut) dimethyl ammonium methosulfate are preferred.

Suitable materials also include dialkyl ethoxyl methyl ammonium methosulphate based on soft fatty acid, dialkyl ethoxyl methyl ammonium methosulphate based on hard fatty acid, and a material in which $R_3$ and $R_4$ represent methyl, $R_1$ is $C_{13-15}$, $R_2$ is $CH_2CH_2OCOR$, where R is stearyl, and X is methosulphate. Ditallow dimethyl ammonium chloride, di(hydrogenated tallow alkyl) dimethyl ammonium chloride, di(coconut alkyl) dimethyl ammonium chloride and di(coconut alkyl) dimethyl ammonium methosulfate are preferred. other preferred cationic compounds include those materials as disclosed in EP No. 239,910 (P&G), which is included herein by reference.

Other preferred materials are the materials of formula

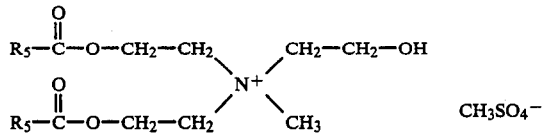

$R_5$ being tallow, which is available from Stepan under the tradename Stepantex VRH 90
and

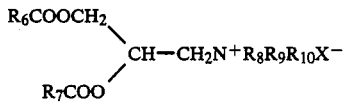

where $R_8$, $R_9$ and $R_{10}$ are each alkyl or hydroxyalkyl groups containing from 1 to 4 carbon atoms, or a benzyl group. $R_6$ and $R_7$ are each an alkyl or alkenyl chain containing from 11 to 23 carbon atoms, and $X^-$ is a water soluble anion. These materials and their method of preparation are described in U.S. Pat. No. 4,137,180 (LEVER BROTHERS).

Another class of preferred water-insoluble cationic materials are the hydrocarbylimidazolinium salts believed to have the formula:

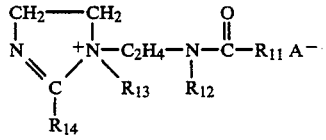

wherein $R_{13}$ is a hydrocarbyl group containing from 1 to 4, preferably 1 or 2 carbon atoms, $R_{11}$ is a hydrocarbyl group containing from 8 to 25 carbon atoms, $R_{14}$ is an hydrocarbyl group containing from 8 to 25 carbon atoms and $R_{12}$ is hydrogen or an hydrocarbyl containing from 1 to 4 carbon atoms and $A^-$ is an anion, preferably a halide, methosulfate or ethosulfate.

Preferred imidazolinium salts include 1-methyl-1-(tallowylamido)ethyl-2-tallowyl-4,5-dihydro imidazolinium methosulfate and 1-methyl-1-(palmitoylamido)ethyl-2-octadecyl-4,5-dihydroimidazolinium chloride. Other useful imidazolinium materials are 2-heptadecyl-1-methyl-1-(2-stearylamido)-ethylimidazolinium chloride and 2-lauryl-1-hydroxyethyl-1-oleyl-imidazolinium chloride. Also suitable herein are the imidazolinium fabric softening components of U.S. Pat. No. 4,127,489, incorporated by reference.

Representative commercially available materials of the above classes are the quaternary ammonium compounds Arquad 2HT (ex AKZO); Noramium M2SH (ex CEKA); Aliquat-2HT (Trade Mark of General Mills Inc), Stepantex Q185 (ex Stepan); Stepantex VP85 (ex Stepan); Stepantex VRH90 (ex Stepan); Synprolam FS (ex ICI) and the imidazolinium compounds Varisoft 475 (Trade Mark of Sherex Company, Columbus Ohio) and Rewoguat W7500 (Trade Mark of REWO).

The compositions according to the invention may also contain, instead of or in addition to the above mentioned softening agents, one or more amine softening materials.

The term "amine" as used herein can refer to (i) amines of formula

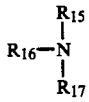

(I)

wherein $R_{15}$, $R_{16}$ and $R_{17}$ are defined as below; amines of formula

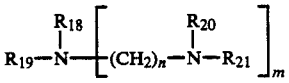

(II)

wherein $R_{18}$, $R_{19}$, $R_{20}$ and $R_{21}$, m and n are defined as below.

(iii) imidazolines of formula

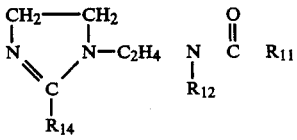

III wherein $R_{11}$, $R_{12}$ and $R_{14}$ are defined as above.

(iv) condensation products formed from the reaction of fatty acids with a polyamine selected from the group consisting of hydrox alkylalkylenediamines and dialkylenetriamines and mixtures thereof. Suitable materials are disclosed in European Patent Application No. 199 382 (Procter and Gamble), incorporated herein by reference.

When the amine is of the formula I above, $R_{15}$ is a $C_6$ to $C_{24}$, hydrocarbyl group, $R_{16}$ is a $C_1$ to $C_{24}$ hydrocarbyl group and $R_{17}$ is a $C_1$ to $C_{10}$ hydrocarbyl group. Suitable amines include those materials from which the quaternary ammonium compounds disclosed above are derived, in which $R_{15}$ is $R_1$, $R_{16}$ is $R_2$ and $R_{17}$ is $R_3$. Preferably, the amine is such that both $R_{15}$ and $R_{16}$ are $C_6$–$C_{20}$ alkyl with $C_{16}$–$C_{18}$ being most preferred and with $R_{17}$ as $C_{1-3}$ alkyl, or $R_{15}$ is an alkyl or alkenyl group with at least 22 carbon atoms and $R_{16}$ and $R_{12}$ are $C_{1-3}$ alkyl. Preferably these amines are protonated with hydrochloric acid, orthophosphoric acid (OPA), $C_{1-5}$ carboxlic acids or any other similar acids, for use in the fabric conditioning compositions of the invention.

When the amine is of formula II above, $R_{18}$ is a $C_6$ to $C_{24}$ hydrocarbyl group, $C_{19}$ is an alkoxylated group of formula $-(CH_2CH_2O)_yH$, where y is within the range from 0 to 6, $R_{20}$ is an alkoxylated group of formula $-(CH_2CH_2O)_zH$ where z is within the range from 0 to 6 and m is an integer within the range from 0 to 6, and is preferably 3. When m is 0, it is preferred that $R_{18}$ is a $C_{16}$ to $C_{22}$ alkyl and that the sum total of z and y is within the range from 1 to 6, more preferably 1 to 3. When m is 1, it is preferred that $R_{18}$ is a $C_{16}$ to $C_{22}$ alkyl and that the sum total of x and y and z is within the range from 3 to 10.

Representative commercially available materials of this class include Ethomeen (ex Armour) and Ethoduomeen (ex Armour).

Preferably the amines of type (ii) or (iii) are also protonated for use in the fabric conditioning compositions of the invention.

When the amine is of type (iv) given above, a particularly preferred material is

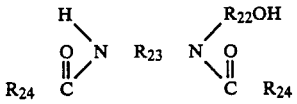

where $R_{22}$ and $R_{23}$ are divalent alkenyl chains having from 1 to 3 carbons atoms, and $R_{24}$ is an acyclic aliphatic hydrocarbon chain having from 15 to 21 carbon atoms. A commercially available material of this class is Ceranine HC39 (ex Sandoz).

The compositions according to the invention may also contain nonionic fabric-softening agents. Suitable nonionic fabric-softening agents include glycerol esters, such as glycerol monostearate, fatty alcohols, such as stearyl alcohol, alkoxylated fatty alcohols, fatty amides, fatty esters, fatty acids, lanolin and derivatives thereof. Suitable materials are disclosed in European Patent Application Nos. 88 520 (Unilever), 122 141 (Unilever) and 79 746 (Procter & Gamble), the disclosures of which are incorporated herein by reference.

Preferably, the conditioners as used in the articles according to the invention contain substantially no anionic materials, in particular no anionic surface active materials. If such materials are present, the weight ratio of the cationic material to the, anionic material in the conditioner should preferably be more than 10:1, such as more than 100:1.

Additionally, the conditioners can contain substances for maintaining the stability of the product on cold storage. Examples of such substances include polyhydric alcohols such as ethylene glycol, propylene glycol, glycerol and polyethylene glycol. A suitable level for such materials is from about 0.5 to about 5%, preferably about 1.0% to 2.0% by weight, based on the weight of the conditioner.

The conditioners of the invention may further include other additional ingredients including colourants, electrolytes, solvents, perfumes, preservatives, antifoams, optical brighteners, opacifiers, pH buffers (the preferred pH for the compositions is between about 3 and about 8, such as from about 4 to about 6), further viscosity modifiers, amphoteric or zwitterionic fabric conditioning agents, anti-shrinkage agents, silicones, anti-wrinkle agents, fabric-crisping agents, spotting agents, soil-release agents, bleaches, whiteners, germicides, anti-oxidants and anti-corrosion agents.

Especially preferred is the use of fabric-conditioning compositions which are mixtures of liquid materials and materials which are solid at ambient temperature. Particularly useful is the use of conditioning materials having a softening temperature of between 30° and 80° C. Examples of mixtures of materials resulting in such melting behaviour are, for instance, softener mixtures based on Arosurf TA 100 (quaternary ammonium salt cationic softener) and Croduret 10 ET 1311 (ethoxylated castor oils) in weight ratios between 5:1 and 1:5.

The substrate is preferably combined with the fabric-conditioning composition by introducing the conditioner into the substrate, for instance by coating or impregnating the substrate with the fabric-conditioning composition. When using this method, it may be preferred to combine the fabric-conditioning composition with a solvent for said composition, followed by applying the solution to the substrate and evaporating said solvent, for instance under low pressure conditions.

For allowing repeated use of the fabric-conditioning article, it is preferred to use fairly high weight ratios of fabric-conditioning material to substrate. A preferred ratio is between 1:5 and 20:1, more preferred between 3:1 and 10:1, most preferred between 3:1 and 7:1.

In use, the fabric-conditioning article according to the invention is introduced into the tumble dryer, for instance by placing it on top of the fabrics to be dried. Upon starting the dryer cycle, the article will spontaneously become attached to the tumble dryer wall where it will consistently remain during this and following dryer cycles. During drying, the temperature inside the tumble dryer will reach a value between 30° and 90° C., most likely about 80° C. This elevated temperature in combination with the moist environment and the mechanical interaction between fabrics and substrate will result in a gradual release of the conditioner material onto the fabrics. After the fabrics have been dried, they will be removed from the dryer. The article according to the invention will remain adhered to the wall of the tumble dryer during one or more subsequent drying cycles. During these cycles, the article will continue to release conditioner material onto the fabrics to be dried. At a certain moment in time the amount of fabric conditioner material on the substrate will reach a value lower than a certain critical value. As soon as this happens, the substrate will no longer adhere to the tumble dryer wall.

It has been found that the moment at which the substrate no longer adheres to the tumble dryer wall coincides with the moment whereupon the amount of fabric conditioning material is so low that the amount of released material per drying cycle is insufficient to effect a satisfactory conditioning benefit. The nonadherence of the substrate to the tumble dryer wall therefore provides a visual indication to the user of the functional exhaustion of the product.

The invention will further be illustrated in the following examples.

EXAMPLE 1

A polymeric material made from a 60/40 weight percent EHA (2-ethyl-hexyl-acrylate)/styrene mixture was prepared according to the method as described in EP No. 68830. A dry sheet of 12×15×0.2 cm, having a weight of 3 g, a void volume of 97% and a cell count of 450 per cm, was impregnated with 14 g of a mixture of 80% by weight Croduret 10 ET and 20% Arosurf TA 100.

For comparison, a polyurethane sheet (Declon ex McKechnie Company) of 12×15×0.2 cm, having a weight of 1.5 g and a cell count of 40 per cm, was impregnated with the same amount of conditioning material.

The products were tested in a Creda Reversair tumble dryer, loaded with 2.5 kg of spin-dried polyester, polyester/cotton and cotton fabrics. The sheets were placed on top of the fabrics which were tumble-dried for 45 minutes at elevated temperature. The sheet of polymeric material spontaneously and consistently adhered to the tumble dryer wall during drying. The polyurethane sheet only incidentally adhered to the tumble dryer wall.

At the end of the drying cycle, the fabrics were removed from the dryer, the polymeric sheet still adhering to the tumble dryer wall. For determining the amount of conditioner material discharged, the polymeric sheet was temporarily removed from the dryer wall. The polyurethane sheet was separated from the fabric load and weighed to determine the amount of conditioner discharged.

The drying cycle was repeated using the same sheets but a fresh load of spin-dried fabrics. The following results were obtained:

TABLE 1

| | conditioner mix delivered per cycle | | | | |
|---|---|---|---|---|---|
| | Cycle N° | | | | |
| | 1 | 2 | 3 | 4 | 5 |
| polymeric sheet | 1.2 | 2.1 | 0.5 | 0.4 | 0.6 |
| polyurethane sheet | 10.6 | 2.1 | 0.2 | — | — |

Thus, under the conditions of this test, polyurethane sheets release an unacceptably high level of active in the first cycle. After the third cycle the amount of active delivered is unsatisfactory for effecting softening benefits. The results show that polyurethane sheets comprising a high active level are not suitable for multi-cycle use in a tumble dryer.

The polymeric sheet, however, gradually releases acceptable levels of the active material during the first 5 cycles. After these cycles the polymeric sheet no longer adheres to the tumble dryer wall, therewith providing a visual indication of the fact that the amount of active as delivered per cycle is insufficient to provide satisfactory softening. Under the conditions of this test, an amount of active of less than about 0.2 g per cycle is considered insufficient for satisfactory softening.

EXAMPLE 2

A polymeric sheet according to Example 1 was impregnated with 25 g of the conditioning material according to Example 1. The product was physically stable and did not show dripping. A polyurethane sheet according to Example 1, impregnated with the same amount of active could not be obtained, because at levels above 14 g the product showed excessive dripping and was not physically stable.

The polymeric sheet material was tested in a tumble dryer as described in Example 1. The sheet gradually released satisfactory levels of conditioning material during 10 tumble dryer cycles, while adhered to the tumble dryer wall. After 10 cycles the product no longer adhered to the tumble dryer wall, thereby providing a visual indication of functional exhaustion of the product.

EXAMPLE 3

A polymeric sheet material as described in Example 1 was impregnated with 20 g of a mixture of 80% by weight Croduret 10 ET and 20% Arosurf TA 100, and 0.26 g of a fluorescer Tinopal CBC X.

The sheet was used in a tumble dryer according to Example 1, in the presence of a new white cotton toweling. After each cycle the toweling was assessed for whiteness in a Zeiss Elrepho reflectometer, a higher score indicating better whiteness. During each subsequent cycle a new toweling was used.

The following results were obtained:

TABLE 2

| Reflectometer score | |
|---|---|
| control* | 0 |
| cycle 1 | 3.4 |

TABLE 2-continued

| Reflectometer score | |
|---|---|
| cycle 2 | 1.7 |
| cycle 3 | 0.8 |

*sheet as above with softener but without fluorescer.

This example shows that, in the presence of a softening material, a gradual release of fluorescer can be obtained during more than one tumble dryer cycle, when a polymeric sheet material of appropriate void volume and cell count is used.

We claim:

1. An article suitable for conditioning fabrics in a tumble dryer, comprising a combination of a substrate and a fabric-conditioning composition, the substrate comprising a porous material having a void volume of more than 90% and a cell count of more than 250 cells per cm, the fabric-conditioning composition comprising a fabric-softening material.

2. An article for conditioning fabrics according to claim 1, characterized in that the substrate is a flexible sheet substrate.

3. An article for conditioning fabrics according to claim 1, characterized in that the substrate is a polymeric substrate material.

4. An article for conditioning fabrics according to claim 1, characterized in that the fabric-conditioning composition comprises a cationic fabric-softening material.

5. An article for conditioning fabrics according to claim 1, characterized in that the fabric conditioner composition has a softening temperature of between 30° and 90° C.

6. An article for conditioning fabrics according to claim 1, characterized in that the weight ratio substrate to fabric-conditioning composition is between 5:1 and 1:20.

7. Method for conditioning fabrics in a tumble dryer comprising the steps of:

(a) introducing an article according to claim 1 into the tumble dryer;

(b) introducing a load of fabrics into the tumble dryer; and (c) operating the dryer at elevated temperatures while the article according to claim 1 is adhered to the tumble dryer wall until the fabrics are of satisfactory dryness.

8. Method for conditioning fabrics in a tumble dryer comprising the steps of:

(a) introducing an article according to claim 1 into the tumble dryer;

(b) introducing a load of fabrics into the tumble dryer;

(c) operating the dryer at elevated temperatures while the article according to claim 1 is adhered to the tumble dryer wall until the fabrics are of satisfactory dryness;

(d) removing the fabrics from the tumble dryer, while the article according to claim 1, remains adhered to the tumble dryer wall; and (e) repeating steps (b) to (d) until the article according to claim 1 no longer adheres to the tumble dryer wall, therewith providing a visual indication of functional exhaustion of the article.

* * * * *